United States Patent [19]

Putzer

[11] 3,998,422

[45] Dec. 21, 1976

[54] FLEXIBLE MOLD HAVING INTERNAL SEAMS

[75] Inventor: Raymond M. Putzer, Racine, Wis.

[73] Assignee: Precision Flexmold, Inc., Racine, Wis.

[22] Filed: Apr. 28, 1975

[21] Appl. No.: 572,099

[52] U.S. Cl. ..... 249/117; 249/127; 264/313; 264/334; 425/440; 425/DIG. 44

[51] Int. Cl.[2] ..... B28B 7/06; B28B 7/20

[58] Field of Search ..... 264/DIG. 50, 334, 335, 264/318, 313; 425/DIG. 57, 440, DIG. 44; 249/178, 66, 117, 183

[56] References Cited

UNITED STATES PATENTS

| | | | |
|---|---|---|---|
| 1,551,603 | 9/1925 | Melosi et al. | 249/178 |
| 1,983,602 | 12/1934 | Daubenmeyer | 264/DIG. 50 |
| 3,776,683 | 12/1973 | Putzer et al. | 425/440 |
| 3,937,438 | 2/1976 | Fox et al. | 264/313 X |

*Primary Examiner*—Ronald J. Shore
*Assistant Examiner*—John S. Brown
*Attorney, Agent, or Firm*—James E. Nilles

[57] ABSTRACT

Molding apparatus for molding articles which are free of seams and parting lines even though the articles may have severe backdraft portions. The apparatus includes a one-piece distensible flexible mold of relatively thick and self-supporting wall construction which is deformable by fluid pressure in order to release the molded article. The flexible walls of the mold include internal slits extending from the mold cavity and partially through the walls for facilitating increased expansion of the mold. The ends of the slits include transversely extending slits in order to prevent tearing of the mold wall at the end of the slit and to further facilitate expansion of the mold.

1 Claim, 5 Drawing Figures

FLEXIBLE MOLD HAVING INTERNAL SEAMS

BACKGROUND OF THE INVENTION

The apparatus of the present invention relates to a one-piece flexible mold for use in conjunction with a vacuum pot for distending the flexible mold radially outwardly to allow an article molded therein to be removed from the mold. Such apparatus facilitates the molding of articles which are completely free of seams or parting lines.

Molding devices employing a flexible mold and vacuum means used for pulling the flexible mold away from the molded article are generally shown in the U.S. Pat. No. 3,776,683, issued Dec. 4, 1973 to Putzer et al. The apparatus disclosed therein illustrates a distensible flexible mold which may be placed within a vacuum pot such that an annular vacuum chamber is formed between the vacuum pot and the mold to cause the flexible mold to be radially outwardly distended away from the formed article thereby permitting the article to be removed from the mold.

SUMMARY OF THE INVENTION

The present invention is an improvement over such prior art flexible molds in that the mold wall is provided with at least one slit extending from the mold cavity partially through the mold wall to facilitate additional expansion or controlled expansion of the flexible mold walls. In many applications of a flexible distensible mold it is desirable to produce a molded article having a substantial undercut portion requiring a mold having a projection extending into the mold cavity. In order to facilitate removal of such a molded article from the flexible mold, when vacuum is applied to distend the mold walls outwardly to release the article, it is necessary to provide for substantial outward deformation of the flexible mold walls in order to allow the projection to be completely withdrawn from the undercut created in the molded article. However, due to the increased thickness of the mold wall in the proximity of the projection, the mold wall resists outward deformation where such deformation is most desired.

In the present invention the flexible molds of the prior art have been improved in that the projections extending into the mold cavity are provided with slits which extend from the interior surface of the projection radially outwardly part way through the projection in the mold wall. The purpose of the slits is to allow nearly uniform outward expansion of the flexible mold walls as the mold is distended to cause the projection to be drawn out of the undercut formed in the molded article. Without the slit that portion of the mold wall including the projection is substantially thicker than the other portions of the mold wall and therefore resists distention more than the remainder of the mold wall. Each of the slits is provided at its radially outward ends with transversely extending slits which prevent the mold wall from ripping at the end of the slit when the mold is distended and facilitate additional expansion of the mold.

DESCRIPTION OF THE PREFERRED EMBODIMENT

Figure 1:
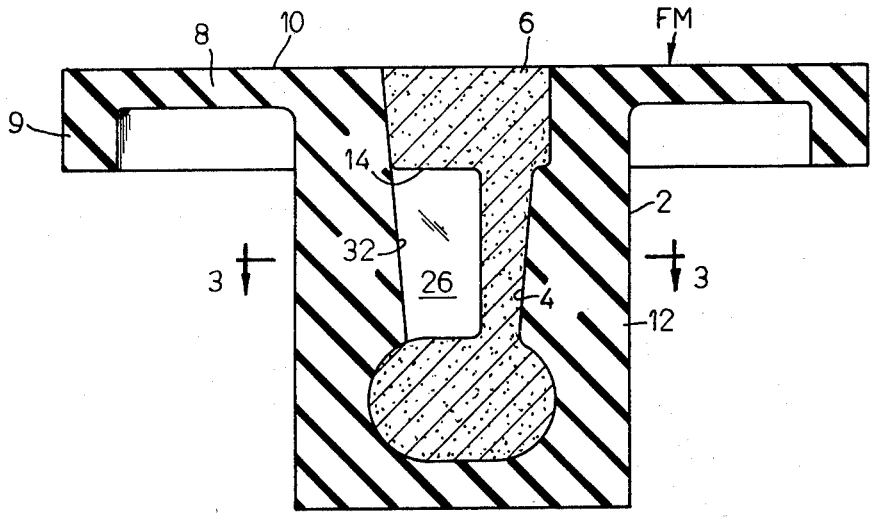
FIG. 1 is a cross sectional side elevation view of the mold of the present invention.

Generally, the present invention is concerned with the production of articles formed of hardenable materials in flexible molds, particularly those having at least one considerable undercut. Various types of hardenable materials may be used with the present invention and include, but are not limited to, plaster, cement, resins, paraffin, polyesters, epoxies, urethane foams, metals and other materials.

The flexible material used to comprise the mold body may be of various types having elastomeric properties and including, but not limited to, polyvinyl chloride "Korogel" produced by B. F. Goodrich of Akron, Ohio; polysulphide cold molding compounds sold by Perma Flex of Columbus, Ohio; and the silastic RTV silicone rubber produced by Dow Corning and General Electric. Polysulphide synthetic rubber material has also been found to be particularly advantageous as a mold material. These materials can be used to produce a mold having a relatively thick and self-supporting wall of considerably varying thickness which is substantially elastomeric and which is also particularly dimensionally stable.

The mold of the present invention is generally shown as comprising a hollow, one-piece distensible flexible mold FM. The flexible mold FM has a main generally cylindrical portion 2 which defines a mold cavity 4 which can be filled with molding material 6. Adjacent the upper end of the cylindrical portion 2 is an integrally formed and relatively thick self-supporting radially extending annular flange 8 having an upper surface 10 which is generally flat, smooth and unobstructed. The periphery of the flange 8 includes a downwardly extending lip 9. The cylindrical portion 2 also includes a side wall 12 which is of a thickness which varies throughout its height to define backdraft or undercut portions 14. The side wall 12 is of such a thickness that it is generally self-supporting and capable of supporting the weight of the molding material 6 poured into the mold cavity 4 without distortion of the flexible mold FM.

Figure 2:
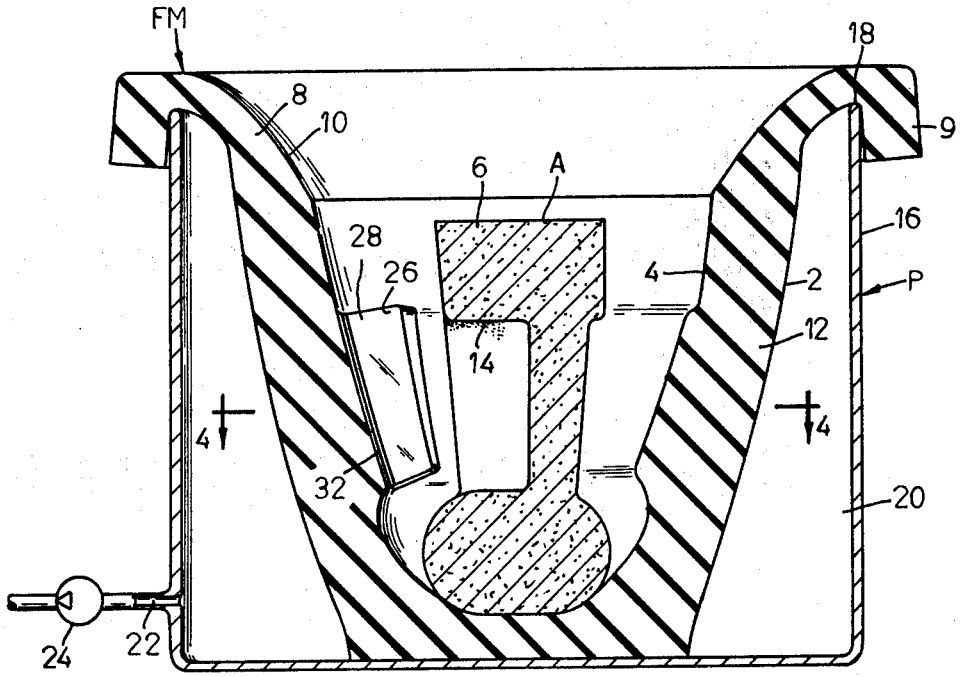
FIG. 2 is a cross sectional side elevation of the mold shown in FIG. 1 placed in a vacuum pot with vacuum applied and causing the mold to be distended.

As shown in FIG. 2, the flexible mold FM may be positioned concentrically within a vacuum pot P. The pot P includes an upwardly extending side wall portion 16 having an upper edge 18 which supports the flange 8 of the flexible mold FM. The flexible mold FM and the vacuum pot P form a sealed generally annular chamber 20 which is connected by means of a passageway 22 leading to a conventional vacuum pump 24. The flexible mold FM is suspended in the vacuum pot P with the lower surface of flange 8 resting on the upper surface 18 of the pot walls. The flexible mold FM is suspended thus without substantial distortion of the flange 8 but with its weight maintaining a seal between the flange 8 and the upper edge 18 of the pot P. The downwardly extending lip 9 of the flange 8 is of sufficient size so as to fit around the upper edge of the pot wall 16 and to center the mold within the pot and to maintain the vacuum seal between the flange 8 and the upper edge 18 of the pot when vacuuum is applied. During the operation of the molding apparatus, when the vacuum is applied by the vacuum pump 24, the pressure differential formed between the chamber 20 and the atmospheric pressure on the upper surface 10 of the flexible mold is sufficient to cause the mold to be forced downwardly into the pot and to subsequently cause the side walls 12 to be forced outwardly toward the wall 16 of the pot P. As shown in FIG. 2, the response to vacuum in chamber 20 is sufficient to pull the mold walls 12 completely away from the molded article A such that the molded article A can be easily lifted out of the flexible mold FM.

Figure 3:
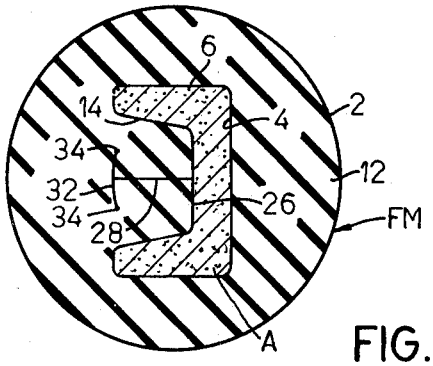
FIG. 3 is a cross sectional view taken along line 3—3 of FIG. 1.

As particularly shown in FIGS. 1 and 3, the mold includes a substantial projection 26 whih extends radially inwardly into the molded article A. As shown in FIG. 3, the portion of te mold wall 12 adjacent the projection 26 is substantially thicker than the other portions of the mold wall 12. As also shown in FIG. 3, the projection 26 includes a slit 28 which extends from the mold cavity 4 radially outwardly through the projection 26 to the mold wall 12. The slit is intersected at its radially outer end by a transversely extending curved slit 32. Each end of the transversely extending slit 32 includes enlarged portions 34. The slits 28 and 32 are confined such that they intersect surfaces of the projection 26 and mold wall 12 only at the mold cavity 4 and do not intersect any of the external surfaces of the mold.

Figure 4:
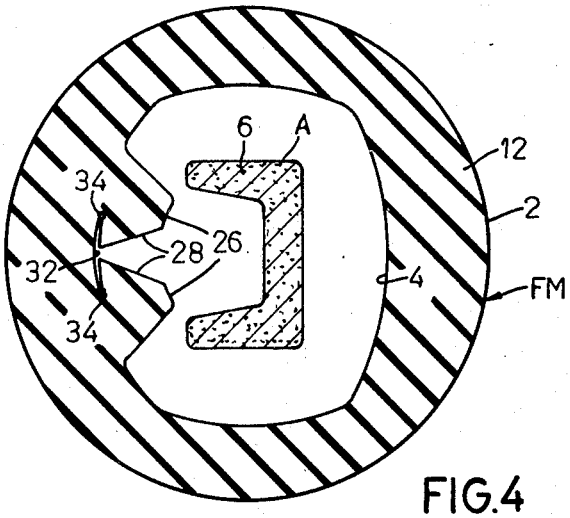
FIG. 4 is a cross sectional view taken along line 4—4 of FIG. 2.

As shown most clearly in FIG. 4, when the flexible mold FM has been placed in the vacuum pot and vacuum has been applied to cause the mold to distend radially outwardly, the slits 28 and 32 serve to allow the mold wall adjacent to the projection 26 to expand uniformly with the rest of the mold wall 12 such that the projection 26 can be withdrawn outwardly from the undercut in the molded article A. It should be noted that the absence of a slit 28 in the projection 26 would result in the mold wall being substantially thicker in the proximity of the projection 26 and would therefore limit the ability of the mold wall to stretch in that proximity when vacuum is applied. The result would be disproportionate stretching of the mold and failure of the projection 26 to be fully withdrawn from the undercut 14 thus preventing the article A from being removed from the mold FM.

Figure 5:
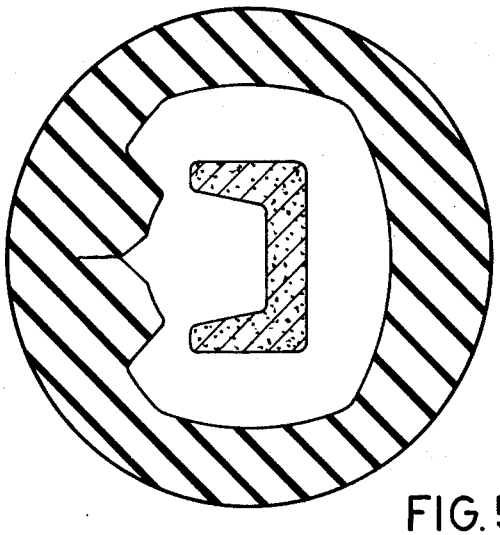
FIG. 5 is a view similar to that of FIG. 4 but showing the reaction of the mold wall to expansion when a transverse slot of the present invention is not provided.

The transverse slit 32 which intersects the slit 28 is intended to prevent a rip or a tear from occurring at the outward end of the slit 28 as is shown occurring in FIG. 5. The transverse slits also function to facilitate an increased capability of expansion, as can be readily appreciated by reference to FIG. 4. The enlargements 34, which are generally small circular bores, are provided at each end of the transverse slit 32 to prevent rips or tears from occurring at the end of the transverse slit 32. The size of the enlargements, however, is small enough to prevent foreign matter, such as particles of the molding material 6, from becoming lodged therein and thereafter preventing complete collapse of the mold to its original position.

RESUME

The present invention thus provides a means for molding articles having substantial undercuts therein and further provides means for facilitating uniform expansion of a flexible mold regardless of variances in the thickness of the mold wall. The mold structure also incluees an improved means of preventing failure of the mold due to the formation of rips or tears in the mold wall.

I claim:

1. A hollow, one-piece distensible flexible mold for molding seamless articles, said mold having a side wall of such thickness that is is generally self-supporting and supports the weight of molding material poured therein without distortion of said mold, said side wall being outwardly expandable to permit removal of an article molded therein, said mold having internal surfaces defining a mold cavity, and said side wall including at least one integral radially inwardly extending projection extending into said mold cavity for defining an undercut in said article, said side wall including first and second openable slits for facilitating withdrawal of said projection from said undercut when said side wall expands outwardly to permit removal of said article and for providing substantially uniform outward expansion of the mold side wall, said first slit comprising a radially extending planar slit bisecting said projection and intersecting one of said internal surfaces, and said first slit extending only partly through said side wall and having a radially outer end, said second slit being an elongated slit extending transversely to said first slit, and intersecting the radial outer end of the first slit to facilitate opening of the first slit during outward expansion of the mold wall and to prevent tearing of the mold wall adjacent the first slit during expansion of the mold wall, said second slit having enlarged portions at each end.

* * * * *